US008827502B2

(12) United States Patent
Liu et al.

(10) Patent No.: US 8,827,502 B2
(45) **Date of Patent: *Sep. 9, 2014**

(54) METAMATERIAL FOR DEFLECTING ELECTROMAGNETIC WAVE

(75) Inventors: Ruopeng Liu, Guangdong (CN); Chunlin Ji, Guangdong (CN); Lin Luan, Guangdong (CN); Jinjin Wang, Guangdong (CN)

(73) Assignees: Kuang-Chi Innovative Technology Ltd., FuTian District, Shenzhen, Guangdong (CN); Kuang-Chi Institute of Advanced Technology, Nanshan District, Shenzhen, Guangdong (CN)

( * ) Notice: Subject to any disclaimer, the term of this patent is extended or adjusted under 35 U.S.C. 154(b) by 199 days.

This patent is subject to a terminal disclaimer.

(21) Appl. No.: 13/522,500

(22) PCT Filed: Nov. 29, 2011

(86) PCT No.: PCT/CN2011/083099

§ 371 (c)(1),
(2), (4) Date: Jul. 17, 2012

(87) PCT Pub. No.: WO2012/139391

PCT Pub. Date: Oct. 18, 2012

(65) Prior Publication Data

US 2012/0327666 A1 Dec. 27, 2012

(30) Foreign Application Priority Data

Apr. 12, 2011 (CN) ..... 2011 1 0091123
Apr. 20, 2011 (CN) ..... 2011 1 0099375

(51) Int. Cl.
*F21V 5/00* (2006.01)
*H01Q 15/00* (2006.01)

(52) U.S. Cl.
CPC ..... *H01Q 15/0086* (2013.01)
USPC ..... 362/330; 362/326; 359/642; 359/652; 359/653

(58) Field of Classification Search
CPC ..... H01Q 15/0086
See application file for complete search history.

(56) References Cited

U.S. PATENT DOCUMENTS

2007/0188385 A1* 8/2007 Hyde et al. ..... 343/700 MS
2008/0165079 A1* 7/2008 Smith et al. ..... 343/911 R
2009/0201572 A1* 8/2009 Yonak ..... 359/316

* cited by examiner

*Primary Examiner* — Elmito Breval
(74) *Attorney, Agent, or Firm* — Winston Hsu; Scott Margo

(57) ABSTRACT

The present embodiment relates to a metamaterial for deflecting electromagnetic wave, includes a functional layer made up by at least one metamaterial sheet layer, each of the metamaterial sheet layers including a substrate and a number of artificial microstructures attached onto the substrate. The functional layer is divided into several strip-like regions. The refractive indices in all the strip-like regions continually increase along the same direction and there are at least two adjacent first and second regions, wherein, the refractive indices in the first region continually increase from $n_1$ to $n_2$, the refractive indices in the second region continually increase from $n_3$ to $n_4$, and $n_2>n_3$. The metamaterial of the present invention that deflects electromagnetic wave has a number of regions disposed thereon. In each region, the refractive indices can continuously increase or decrease so that the electromagnetic waves within the regions will be slowly deflected.

20 Claims, 7 Drawing Sheets

METAMATERIAL FOR DEFLECTING ELECTROMAGNETIC WAVE

FIELD OF THE INVENTION

The present invention relates to the field of metamaterial, and more specifically to a metamaterial that deflects electromagnetic wave.

BACKGROUND OF THE INVENTION

Metamaterial is a novel kind of material, which consists of based material, and a number of artificial microstructures attached on the surface of the based material or embedded in the interior of the based material. The artificial microstructure is made up by cylindrical or flat wires forming predetermined geometric figure, such as circular ring, "I" shaped wires, and the like. The based material act as support to the artificial microstructures. The based material can be any material that is different from the material of artificial microstructures. Combination of the two kinds of materials can develop an equivalent dielectric constant and permeability in space. The equivalent dielectric constant and equivalent permeability of each point in the metamaterial can be designed by designing the shape and arrangement of each artificial microstructure in the metamaterial.

When an electromagnetic wave beam is propagating from one medium to another medium, the electromagnetic wave will be refracted. When the refractive indices distribution of the material is heterogeneous, the electromagnetic wave will deflect towards locations with relatively large refractive indices. The refractive indices of electromagnetic wave is directly proportional to $\sqrt{\in\times\mu}$. Therefore, by changing the distribution of dielectric constant $\in$ and/or permeability $\mu$ material, the purpose of changing the propagation path of electromagnetic wave can be achieved.

In prior art, the deflection of the electromagnetic waves is achieved by changing the direction of the electromagnetic waves by means of mechanical adjustment. However, the deflection of the electromagnetic waves by means of mechanical adjustment is not flexible enough, and the adjustment is not convenient.

SUMMARY OF THE INVENTION

In view of the drawbacks in prior art, the technical problem to he solved by the present invention is to provide a metamaterial that deflects electromagnetic wave.

In order to solve the above problem, a metamaterial for deflecting electromagnetic wave is provided, including a functional layer made up by at least one metamaterial sheet layer. Each of the metamaterial sheet layers includes a substrate and a number of artificial microstructures attached onto the substrate. The functional layer is divided into a plurality of strip-like regions. The refractive indices in all the strip-like regions continuously increase along the same direction and there are at least two adjacent first and second regions wherein the refractive indices in the first region continuously increase from $n_1$ to $n_2$, the refractive indices in the second region continuously increase from $n_3$ to $n_4$, and $n_2>n_3$.

Further, the functional layer of the metamaterial is formed by a number of metamaterial sheet layers with non-uniform refractive indices stacked in a direction perpendicular to the surface of the metamaterial sheet layers.

Furthermore, each artificial microstructure comprises a planar structure or a spatial structure made up by at least one wire.

Still further, the wire(s) is copper wire or silver wire.

Moreover, the wires are attached to the substrate by means of etching, electroplating, drilling, photolithography, electron etching, or ion etching.

Further, the substrate is made of ceramic, polymer materials, ferroelectric materials, ferrite materials or ferromagnetic materials.

Furthermore, the artificial microstructure is axially symmetric structure.

Moreover, the artificial microstructure is in the form of "I" shape, cross shape or back-to-back double E-shape.

Further, the artificial microstructures are non-axially symmetric structure including scalene triangle, parallelogram or other irregular closed curve.

Further, the metamaterial also includes impedance matching layers disposed on two sides of the functional layer.

In order to solve the above technical problem, another metamaterial for deflecting electromagnetic wave is provided. The metamaterial includes a number of metamaterial sheet layers stacked integrally in x direction. Each of the metamaterial sheet layers includes a number of metamaterial unit cells arranged in array, wherein, the y direction perpendicular to x direction is columns of the array and the z direction perpendicular to x and y directions is rows of the array. Each metamaterial unit cell has completely identical based material unit cell and artificial microstructures attached to the based material unit cell. The refractive indices in each row of the metamaterial unit cells are equal. The refractive indices of each column of the metamaterial unit cells sequentially are $a_1$, $a_2$, $a_3$, . . . , $a_s$, $b_1$, $b_2$, $b_3$, . . . , $b_q$. Each of the refractive indices satisfies $a_1\leq a_2\leq a_3 \ldots \leq a_s$, $b_1\leq b_2\leq b_3 \ldots \leq b_q$, wherein $b_1<a_s$, and s and q are natural number no less than 2. Therefore, the artificial microstructure is a non 90-degree rotationally symmetric structure, and the extraordinary light optical axes of the index ellipsoids of at least part of the artificial microstructures are not perpendicular and not parallel to y direction.

In the metamaterial for deflecting electromagnetic wave of the present invention, the refractive indices of each column of the metamaterial unit cells also has the following relationship: $(a_2-a_1)\geq(a_3-a_2) \ldots \geq(a_s-a_{s-1})\geq(b_2-b_1)\geq(b_3-b_2) \ldots \geq(b_{q-1}-b_q)$.

In the metamaterial for deflecting electromagnetic wave of the present invention, the refractive indices also has the following relationship: $a_1=b_1$, $a_s=b_q$, $q>s$.

In the metamaterial for deflecting electromagnetic wave of the present invention, the size of each metamaterial unit cell is no more than 1/10 of the wavelength of the incident electromagnetic wave.

In the metamaterial for deflecting electromagnetic wave of the present invention, the extraordinary light optical axes of the respective index ellipsoids of the artificial microstructures in each row of the metamaterial unit cells in z direction are parallel to each other.

In the metamaterial for deflecting electromagnetic wave of the present invention, the extraordinary light optical axes of the respective index ellipsoids of the artificial microstructures in each column of the metamaterial unit cells in y direction are sequentially rotated clockwise, and the extraordinary light optical axes of the index ellipsoids of the row of artificial microstructures with refractive indices $b_q$ are parallel to y direction.

In the metamaterial for deflecting electromagnetic wave of the present invention, the refractive indices distribution of the number of the metamaterial sheet layers are completely identical so that the refractive indices of the metamaterial unit cells in each stacked row in x direction remain constant.

In the metamaterial for deflecting electromagnetic wave of the present invention, the geometric figures of the artificial microstructures are similar but the sizes increase with the increase of the refractive indices or decrease with the decrease of the refractive indices.

In the metamaterial for deflecting electromagnetic wave of the present invention, the artificial microstructures are in the form of "I" shape or Jerusalem cross shape.

The above technical solution at least has the following beneficial effects: the metamaterial for deflecting electromagnetic wave has a number of regions. The refractive indices of the metamaterial in each strip-like region continuously increase. There are at least two first and second regions, wherein, in the first region, the refractive indices continuously increases from $n_1$ to $n_2$, and in the second region, the refractive indices continuously increases from $n_3$ to $n_4$, and $n_2>n_3$. The non-uniform metamaterial of the present invention can deflect electromagnetic wave in a convenient and flexible way, and its manufacturing is simple and suitable for mass production.

BRIEF DESCRIPTION OF THE DRAWINGS

To describe the technical solutions of embodiments of the present disclosure more clearly, the attached drawings necessary for description of the embodiments will be introduced briefly hereinbelow. Obviously, these attached drawings only illustrate some of the embodiments of the present disclosure, and those of ordinary skill in the art can further obtain other attached drawings according to these attached drawings without making inventive efforts. In the attached drawings.

DETAILED DESCRIPTION OF THE INVENTION

Figure 1:
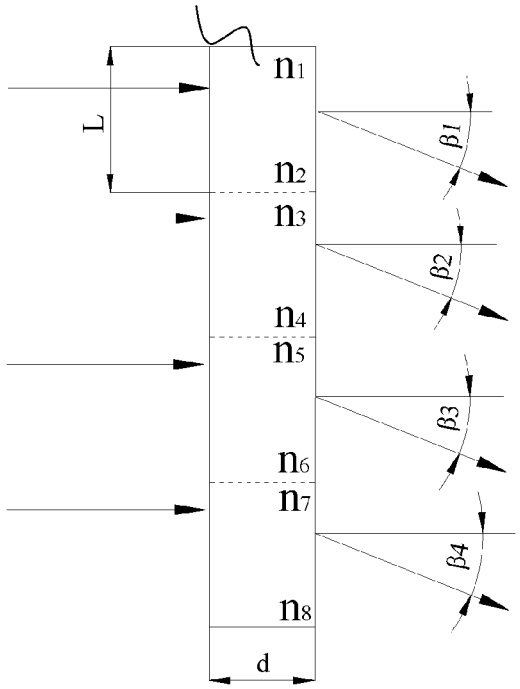
FIG. 1 is a principle diagram of the metamaterial of the present invention that deflects electromagnetic wave.

The refractive indices of electromagnetic wave is directly proportional to $\sqrt{\in\times\mu}$. When an electromagnetic wave beam is propagating from one medium to another medium, the electromagnetic wave will be refracted. When the refractive indices distribution in the substance is heterogeneous, the electromagnetic wave will deflect towards locations with relatively larger refractive indices. Therefore, by changing the distribution of dielectric constant $\in$ and/or permeability $\mu$ in material, the purpose of changing the propagation path of electromagnetic wave can be achieved.

First, referring to FIG. 1 to FIG. 5, the metamaterial of the present invention that deflects electromagnetic wave will be described in more detail by means of the first embodiment to the third embodiment.

Metamaterials are novel type of materials that have artificial microstructures 2 as its basic unit cells that are spatially arranged in particular way and have special electromagnetic response. Metamaterial comprises artificial microstructures 2 and substrate 1 to which the artificial microstructures attach. The artificial microstructure 2 is a planar structure or a stereo structure made up by at least one wire. A number of artificial microstructures 2 are arranged on the substrate 1 in array. Each of the artificial structures 2 and the portion on the substrate 1 that the artificial structure 2 occupied constitute a metamaterial unit. The substrate 2 can be any material that is different from the material of the artificial microstructures 2. The superposition of two kinds of materials can cause each metamaterial unit cell to develop an equivalent dielectric constant and permeability. The equivalent dielectric constant and permeability correspond to electric field response and magnetic field response of the metamaterial unit cell respectively. The electromagnetic response characteristics of the metamaterial are determined by the characteristics of the artificial microstructures 2, and the electromagnetic response of the artificial microstructures 2 in turn to a large extent depends on the topological characteristics formed by the pattern of their wires and their geometric dimensions. By designing the pattern and geometric dimension of each artificial microstructure 2 arranged in the space of the metamaterial according to the above principle, the electromagnetic parameter of each point in the metamaterial can be set.

FIG. 1 is a principle diagram showing how the metamaterial 10 of the present invention that deflects electromagnetic wave deflects electromagnetic wave. The metamaterial includes a functional layer 10 and impedance matching layers (not shown) disposed on two sides of the functional layer 10. As shown, the functional layer 10 of the metamaterial has 4 strip-like regions 4 with continuously increasing refractive indices. The refractive indices in the first region increases continuously from $n_1$ to $n_2$; the refractive indices in the second region increases continuously from $n_3$ to $n_4$; the refractive indices in the third region increases continuously from $n_5$ to $n_6$; and the refractive indices in the fourth region increases continuously from $n_7$ to $n_8$, wherein $n_2>n_3$, $n_4>n_5$, $n_6>n_7$. After a parallel incident electromagnetic wave beam passing through the metamaterial with the above described refractive indices distribution rule, the emergent electromagnetic wave all deflects in a direction towards the fourth region. The refractive indices of the metamaterial in each strip-like region 4 can increase continuously linearly or increase continuously non linearly, as long as the refractive indices of the functional layer 10 in all the strip-like regions 4 continuously increase in the same direction and there are at least two adjacent first and second regions, wherein, the refractive indices in the first region continually increase from $n_1$ to $n_2$, the refractive indices in the second region continually increase from $n_3$ to $n_4$, and $n_2>n_3$. Therefore, the deflection of the electromagnetic wave towards the same direction can be achieved.

In the figure, L represents the length of the strip-like region 4. In this embodiment, the 4 strip-like regions 4 have equal length L and satisfy the following relationship:

(1) $n_2>n_3$, $n_4>n_5$, $n_6>n_7$;

(2) the refractive indices in all the strip-like regions 4 increase or decrease along the same direction.

Experiments show that the deflection angle of electromagnetic wave passing though the functional layer 10 of metamaterial and the thickness and change rate of refractive indices of the functional layer 10 should satisfy the following relationship formula:

$$d\cdot\Delta n=\sin\beta;$$

wherein d represents the thickness of the functional layer 1; Δn represents refractive indices change rate of adjacent two metamaterial unit cells; and β represents deflection angle.

Given the thickness d of the functional layer 10, in order to realize the deflection angles β1=β2=β3=β4 shown in FIG. 1, proper Δn of adjacent two metamaterial unit cells should be determined. By reasonably designing the refractive indices distribution of each metamaterial sheet layer 3 and the number of metamaterial sheet layer 3 to make Δn remain constant, parallel incident electromagnetic waves can deflect towards the same direction in parallel.

Furthermore, because refractive indices of electromagnetic wave is directly proportional to $\sqrt{\in\times\mu}$, the refractive indices can be changed by changing at least one of the dielectric constant and permeability. Experiments show that as to the artificial microstructures 2 with identical patterns, their geometric dimensions are directly proportional to the dielectric constant. As a result, given the incident electromagnetic wave, the refractive indices distribution of the metamaterial can be adjusted by reasonably designing the pattern of the artificial microstructures 2 and the arrangement of the artificial microstructures 2 on the metamaterial sheet layer(s), thereby achieving the purpose of deflecting parallel incident electromagnetic waves toward the same direction to exit.

Figure 2:
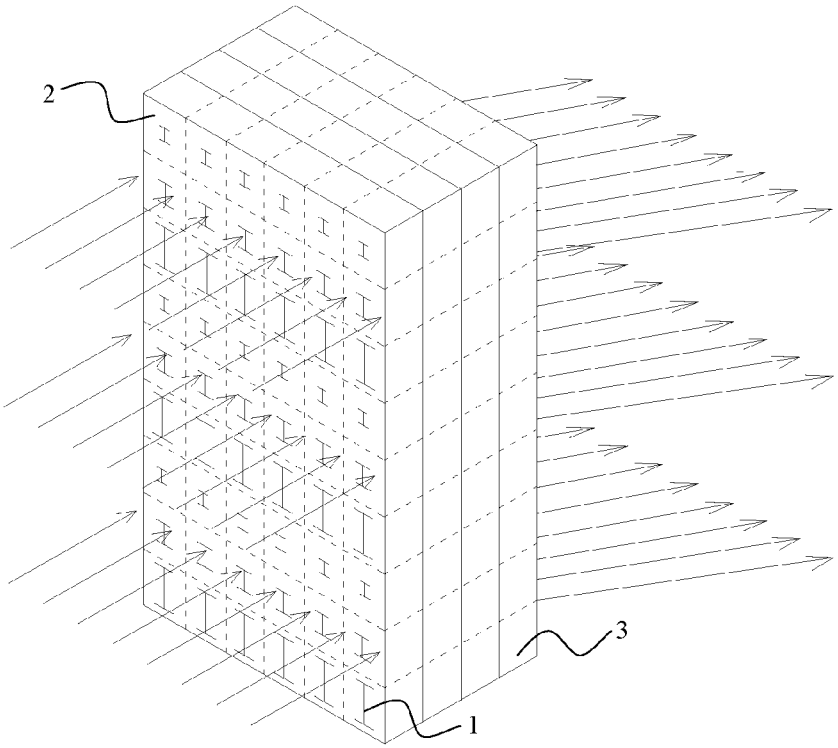
FIG. 2 is a schematic view showing structure of the metamaterial of the present invention according to the first embodiment.
Figure 3:
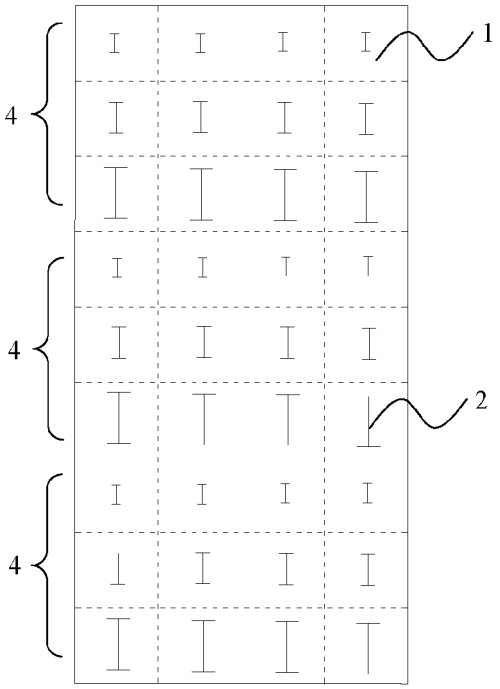
FIG. 3 is a front view of the metamaterial shown in FIG. 2.

FIG. 2 and FIG. 3 are schematic view and front view showing structure of metamaterial of the present invention that deflects electromagnetic wave according to the first embodiment. In this embodiment, the functional layer 10 is made up by a number of non-uniform metamaterial sheet layers 3 stacked integrally along a direction perpendicular to their surface. Each metamaterial sheet layer 3 includes a sheet-like substrate 1 and a number of artificial microstructures 2 attached to the substrate 1. In this embodiment, the artificial microstructure 2 is in the form of "I" shape. Arrays of artificial microstructures 2 are distributed on substrate 1. As shown, the functional layer 10 of metamaterial is divided into several strip-like regions 4. The dimensions of the "I" shaped artificial microstructures 2 in each strip-like region 4 continuously increase. Therefore, the refractive indices of the metamaterial of the strip-like region 4 continuously increase. When parallel electromagnetic waves are incident onto the metamaterial of the present embodiment, emergent electromagnetic waves will deflect towards the direction with larger refractive indices. By reasonably designing the changing rule of the dimensions of the "I" shaped artificial microstructures 2, the parallel incident electromagnetic waves can deflect towards the same direction in parallel to exit.

Figure 4:
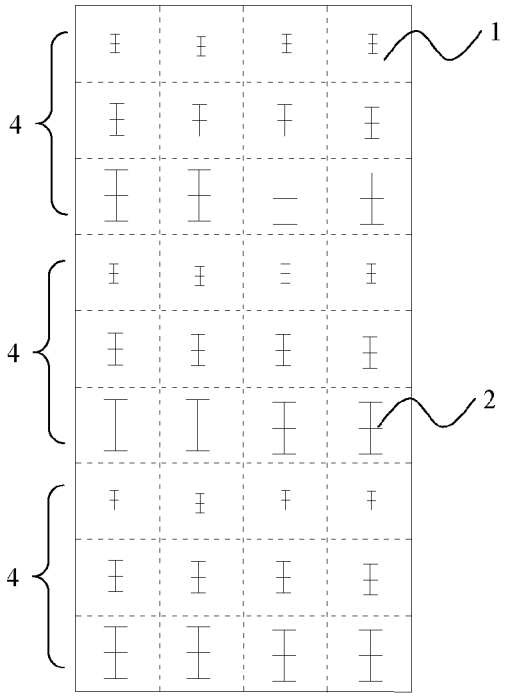
FIG. 4 is a front view of metamaterial of the present invention according to a second embodiment.
Figure 5:
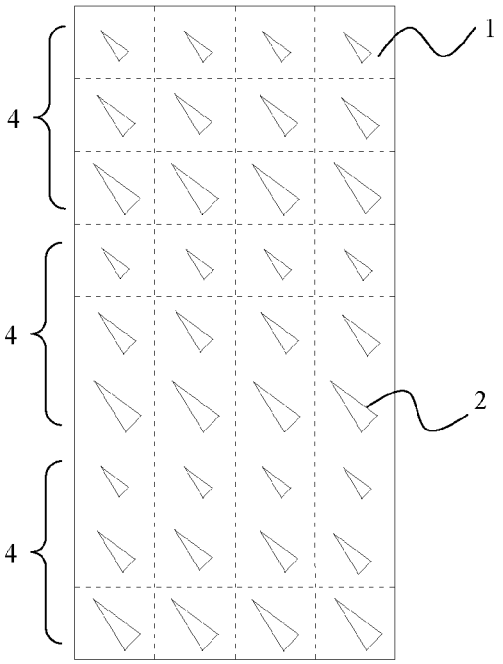
FIG. 5 is a front view of metamaterial of the present invention according to a third embodiment.

FIG. 4 and FIG. 5 are front views showing metamaterials of the present invention that deflects electromagnetic waves according to second embedment and third embodiment respectively. In the embodiments shown in FIG. 4 and FIG. 5, the arrangement rule of the artificial microstructures 2 is identical to that shown in FIG. 3 except the geometric shapes of the artificial microstructures 2 shown in FIG. 4 and FIG. 5 are different. The artificial microstructures 2 shown FIG. 4 are in the form of back-to-back double E-shape, but other axisymmetric structures such as cross shape can also be used, as long as the refractive indices of the metamaterial in the strip-like regions 4 increase or decrease continuously so as to achieve deflection of electromagnetic wave. In the embodiment shown FIG. 5, the artificial microstructures 2 are scalene triangle, but other non axisymmetric structure such as parallelogram or other irregular closed curve can also be used.

In implementation, dielectric constant and permeability can be derived by calculation and simulation. Then shapes and dimensions of the artificial microstructures 2 can be continuously adjusted until the values of their dielectric constant and permeability satisfy the above described refractive indices distribution thereby achieving parallel deflection exiting of the parallel electromagnetic waves towards the same direction.

The artificial microstructure 2 is made up by at least one wire such as copper wire or silver wire, has particular graphic. The wires can attach to the substrate 1 by means of etching, electroplating, drilling, photoengraving, electronic engraving or ion engraving and the like. Among them, etching is a preferred manufacture process. Etching process includes the following steps: after suitable planar pattern of the artificial microstructures 2 has been designed, attaching a whole piece of metal foil to the substrate 1; removing portions of the metal roil except the preset pattern of the artificial microstructures 2 by means of etching apparatus through chemical reaction between solvent and metal; and the remaining portions yielding artificial microstructures 2 arranged in array. The substrate 1 can be made of ceramic, polymer materials, ferroelectric materials, ferrite materials or ferromagnetic materials.

The metamaterial of the present invention that deflects electromagnetic wave has a number of regions disposed thereon. In each region, the refractive indices can continuously increase or decrease so that the electromagnetic waves within the regions will slowly defect to direction with larger refractive indices. By reasonably designing the distribution of the shapes and dimensions of the artificial microstructures 2, the parallel incident electromagnetic waves can deflect towards the same direction in parallel when exiting. The metamaterial of the present invention that deflects electromagnetic wave can achieve electromagnetic wave deflection in a convenient and flexible way, and its manufacture process is simple and suitable for mass production.

In the following, metamaterials of the present invention that deflects electromagnetic waves according to the fourth embodiment to sixth embodiment will be described in more detail referring to FIG. 6 to FIG. 16.

Figure 6:
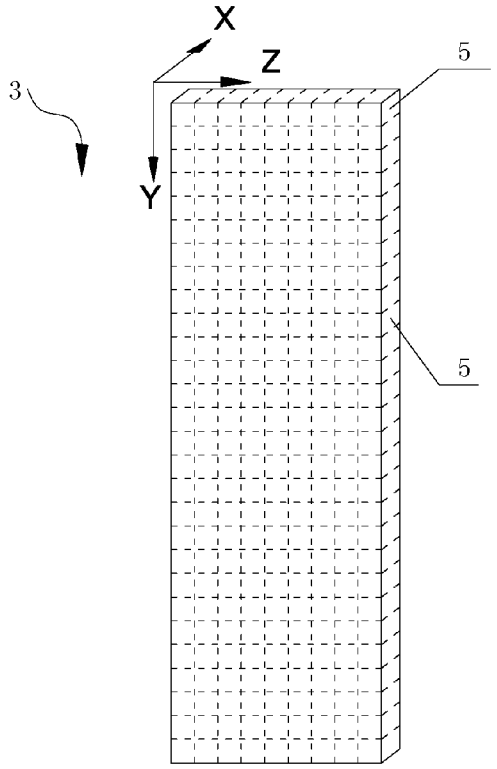
FIG. 6 is a schematic view showing structure of each metamaterial sheet layer.

Metamaterial of the present invention that deflects electromagnetic wave includes a number of metamaterial sheet layers 3. As shown in FIG. 6, each metamaterial sheet layer 3 has two parallel front and back surfaces, thus is a sheet layer with uniform thickness. The thickness direction of the metamaterial sheet layer 3 is defined as x direction, the length direction of the metamaterial sheet layer 3 is defined as y direction, and the width direction is defined as z direction, wherein the x direction, y direction and z direction are perpendicular to each other.

The metamaterial sheet layer 3 include a sheet-like based material 6 with uniform thickness and a number of artificial microstructures 2 attached to the sheet-like based material 6. The sheet-like based material 6 is virtually divided into a number of completely identical cube shaped grids. Each grid is a based material unit. Each based material unit cell is attached an artificial microstructure 2. Each based material unit cell and the attached artificial microstructure 2 collectively constitute a metamaterial unit cell 5. The entire metamaterial sheet layer 3 is regarded as first array made up by a number of artificial microstructures 2 with z direction as row and y direction as column. The cube shaped grids herein can have dimensions arbitrarily freely divided. In present invention, preferably, all of the lengths in y direction or z direction should be 1/10 of the wavelength of electromagnetic wave to be deflected. The length in x direction should be equal to the thickness of the sheet-like based material 6 in x direction, generally also 1/10 of said wavelength. Of course, the lengths of the metamaterial unit cell of the present invention in y direction and z direction can be 1/5 of the wavelength of the electromagnetic wave, preferably no more than 1/10 of said wavelength.

Figure 8:
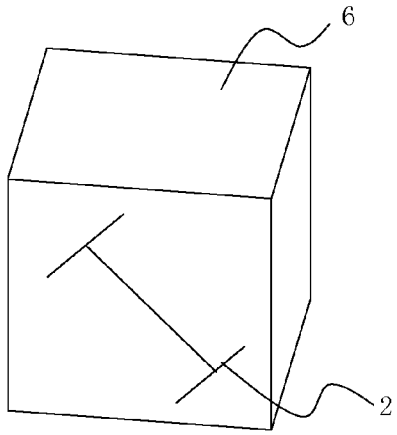
FIG. 8 is a schematic view showing structure of artificial microstructure according to a fourth embodiment.
Figure 9:
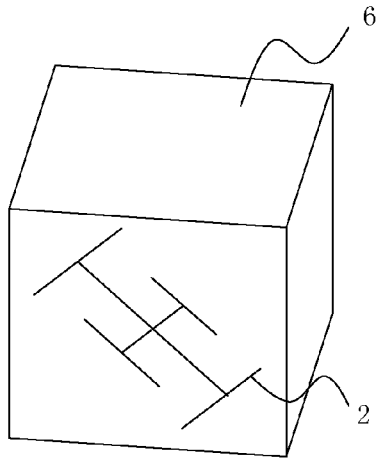
FIG. 9 is a schematic view showing structure of artificial microstructure according to a fifth embodiment.
Figure 10:
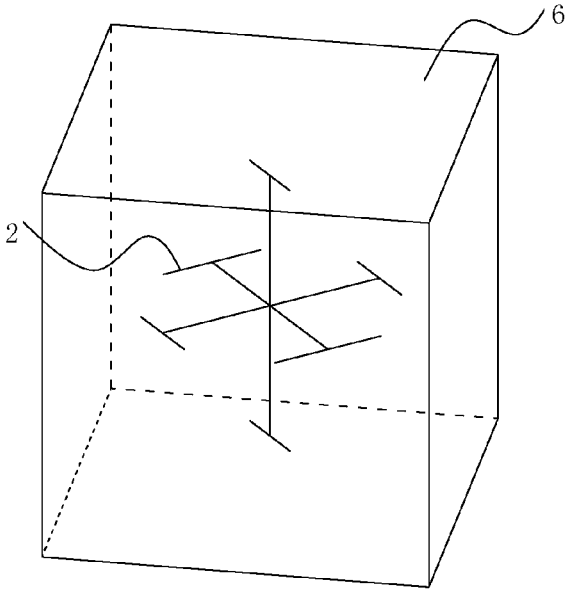
FIG. 10 is a schematic view showing structure of artificial microstructure according to a sixth embodiment.

The specific structures of the metamaterial unit cells 5 are as shown in FIG. 8, FIG. 9 and FIG. 10. The metamaterial unit cell 5 shown in FIG. 8 includes a based material unit cell and an artificial microstructure 2 attached to the surface of the based material unit. The artificial microstructure 2 in this embodiment is made up by wires in planar "I" shape, which includes a linear first wire and two second wires perpendicularly connected at two ends of the first wire respectively. The metamaterial unit cell 5 shown in FIG. 9 is in planar two dimensional snow flake shape which includes two first wires perpendicularly intersected with each other forming cross shape and four second wires perpendicularly connected at two ends of each first wire respectively. The metamaterial unit cell 5 shown in FIG. 10 is in stereo three dimensional snow flake shape, including three first wires perpendicular to each other and intersected at one point and six second wires perpendicularly connected at two ends of each first wire respectively. The stereo artificial microstructure 2 attaches to the inside of the based material 3 by certain processing procedure.

Of course, there are plenty of ways to realize the artificial microstructures 2 of the present invention. Any microstructure can be used as artificial microstructure 2 of the present invention to attach to the surface of the based material 3 or embedded inside of the based material 3 thereby forming the metamaterial unit cell 5 of the present invention, as long as the structure with certain geometric graphic made up by wire(s) or metal thread(s) can have response to electromagnetic field and thus change property of electromagnetic field.

Because different artificial microstructures 2 can make respective metamaterial unit cells 5 have different dielectric constant and permeability, and thus have different electromagnetic response to electromagnetic waves. Among them, an important response effect is to change the propagation direction of electromagnetic wave. By designing dielectric constant and permeability of each metamaterial unit cell 5 to set the change amount of the propagation direction of the electromagnetic wave passing through each metamaterial unit cell 5, the metamaterial of the present invention that deflects electromagnetic wave can deflect all incident electromagnetic waves to a direction by collective action of all the metamaterial unit cells 5.

Refractive indices can represent the change of propagation direction of electromagnetic wave. Given refractive indices $n=\sqrt{\mu\in}$, wherein $\mu$ is permeability and $\in$ is dielectric constant. From this, under the condition that the permeability $\mu$ remains constant, the change rule of the dielectric constant $\in$ can be inferred from the change rule of the refractive indices n. Therefore, all descriptions relating to the change rule of refractive indices n can be construed that the change rule of dielectric constant can be similarly inferred according to above formula.

Figure 7:
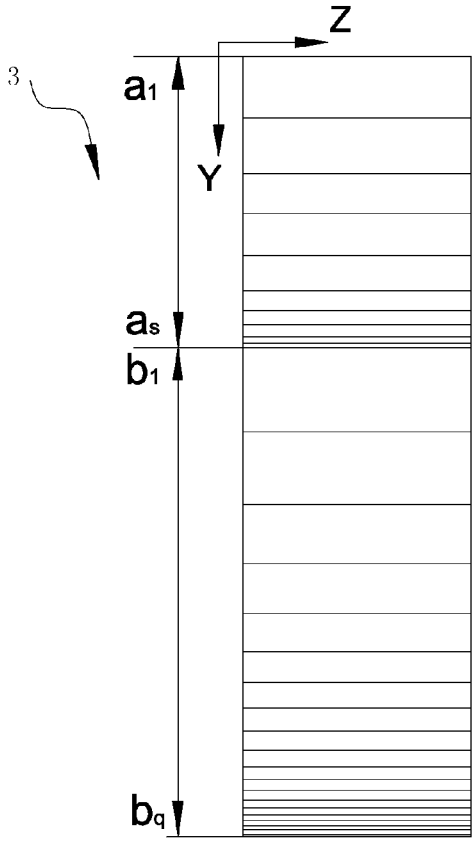
FIG. 7 is a schematic view showing refractive indices distribution of the metamaterial sheet layer shown in FIG. 6.

The refractive indices distribution of each metamaterial sheet layer 3 is as shown in FIG. 7. The refractive indices of a column of metamaterial unit cells 5 along y direction sequentially are $a_1, a_2, a_3, \ldots, a_s, b_1, b_2, b_3, \ldots, b_q$, and each refractive indices should satisfy the following relationship:

$$a_1 \le a_2 \le a_3 \ldots \le a_s \tag{1}$$

$$b_1 \le b_2 \le b_3 \ldots \le b_q \tag{2}$$

wherein $b_1 < a_s$, and s, q are natural numbers no less than 2. Each row of the metamaterial unit cells 5 along z direction have identical refractive indices.

Portion of the metamaterial with refractive indices $a_1$ to $a_s$ is defined as first metamaterial segment 100. Portion of the metamaterial with refractive indices $b_1$ to $b_q$ is defined as second metamaterial segment 200.

When relationship formulas (1) and (2) do not adopt equal sign at the same time, that is to say, when the refractive indices distribution of the first metamaterial segment 100 and second metamaterial segment 200 are not uniform, the phase propagation direction of the electromagnetic wave will deflect towards direction with larger refractive indices. Therefore, the electromagnetic wave incident onto the first metamaterial segment 100 will deflect to the metamaterial unit cell 5 with $a_s$ when exiting, and the electromagnetic wave incident onto the second metamaterial segment 200 will deflect to the metamaterial unit cell 5 with $a_q$ when exiting.

Since the defection angle is between the exit direction and the incident direction of the electromagnetic wave, the bigger the change amount between adjacent metamaterial unit cells 5, the bigger the deflection angle of the electromagnetic wave when exiting will be. Therefore, in order to let all the electromagnetic waves to deflect to the same direction, the refractive indices of each column of the metamaterial unit cells along y direction should satisfy the following relationship:

$$(a_2-a_1) \ge (a_3-a_2) \ldots \ge (a_s-a_{s-1}) \ge (b_2-b_1) \ge (b_3-b_2) \ldots \ge (b_{q-1}-b_q) \tag{3}$$

When relationship formula (3) adopts equal sign at the same time, the deflection angles of the electromagnetic waves when exiting are the same. Therefore, when the incident electromagnetic waves are planar electromagnetic waves, it will still be planar electromagnetic waves but with changed phase.

Figure 11:
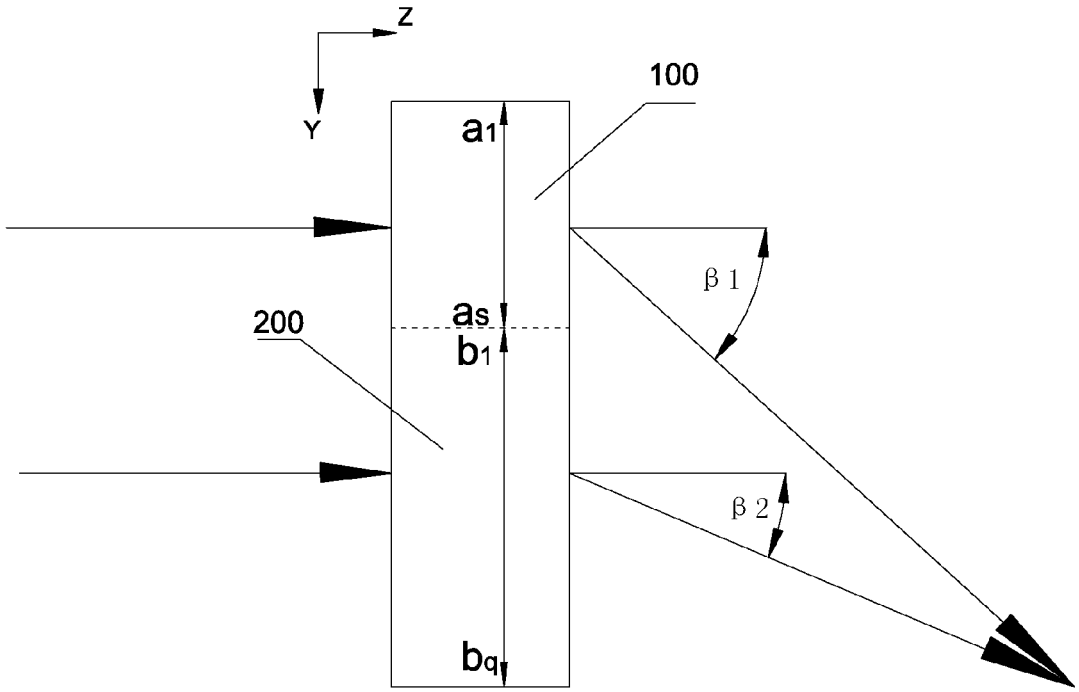
FIG. 11 is a schematic view showing the deflection of electromagnetic wave by the metamaterial sheet layer shown in FIG. 7.

When relationship formula (3) does not adopt equal sign at the same time or does not adopt equal sign at all, as to a parallel incident electromagnetic wave beams, the nearer to the position of the metamaterial unit cell 5 with refractive indices $b_q$, the smaller the change amount of the refractive indices will be; the nearer to the position of the metamaterial unit cell with refractive indices $a_1$, the bigger the change amount of the refractive indices will be. By design and calculation, they can converge to a point as shown in FIG. 11 by making these deflection angles satisfy rules sequentially. Like convex lens, given the deflective angle of the light by each surface point and the refractive indices of material, respective surface curvature characteristics can be designed to realize converging function. Similarly, in present invention, the artificial microstructure 2 of each metamaterial unit cell 5 can be designed to obtain certain dielectric constant ∈ and permeability μ of the unit cell and thus the refractive indices n. The change amount of the refractive indices n of each adjacent metamaterial unit cell 5 can be designed so that the electromagnetic waves can be deflected towards a certain point so as to achieve the purpose of converging to a point.

For example, two electromagnetic wave beams shown in FIG. 11 are incident onto the first metamaterial segment and second metamaterial segment of the metamaterial sheet layer 3 respectively, and both of the electromagnetic wave beams are parallel to z direction. By calculating the defection angles β5 and β6 of the electromagnetic wave relative to z direction when exiting, they can be made to converge to a point after passing through the metamaterial sheet layer 3. Referring to Metamaterials: Theory, Design, and Applications, Publisher: Springer, ISBN 1441905723, page 75-76, we can derived that the relationship between the change amount of refractive indices Δn and the deflection angle β (for example, β5, β6) have the following relationship:

$$d \cdot \Delta n = \sin \beta \tag{4}$$

wherein, d is length of the metamaterial sheet layer 3 along z direction; Δn is the difference between the refractive indices of two adjacent rows of metamaterial unit cells. Given d and sin β, Δn can be solved. Take a refractive indices as a cardinal number, the refractive indices of adjacent two rows of metamaterial unit cells can be deduced. By calculating the defection angles of all positions, the refractive indices distribution of the metamaterial sheet layer 3 along y direction can be finally deduced. The dielectric constant and permeability of the artificial microstructures 2 can he derived by calculation and simulation and then the shapes and dimensions of the artificial microstructures 2 can be adjusted until the values of their dielectric constant and permeability satisfy the above described refractive indices distribution.

Furthermore, for comparing magnitude, on the previous basis, each of the refractive indices also satisfy the following relationship:

$$a_1 = b_1,\ a_s = b_q \tag{5}$$

From this, the initial values and the final values of the column of refractive indices of the first metamaterial segment 100 and the second metamaterial segment 200 along y direction are equal, that is to say the total change amounts of the refractive indices of the two metamaterial segments are equal. When q>s, i.e., the number of metamaterial unit cells in each column of the first metamaterial segment 100 is larger than that of the second metamaterial segment 200, under the condition that total change amounts are equal, the average change rate of the refractive indices of the first metamaterial segment 100 is larger than that of the second metamaterial segment 200, then the deflection angles β5>β6. As shown in FIG. 7, the density of lines represents the magnitude of the refractive indices. The lower the density, the larger the magnitudes of the refractive indices are. The faster the change of the density, the larger the change rate of the refractive indices will be.

When the above relationship formulas (1) and (2) adopt equal sign at the same time,.the relationship formula (3) should also adopt equal sign and equal to zero. That is to say, both of the first metamaterial segment 100 and the second metamaterial segment 200 are materials with uniform refractive indices distribution. At the same time, three situations will occur to the electromagnetic wave incident along a direction parallel to z direction:

1) when each metamaterial segment is isotropic to electromagnetic wave, the electromagnetic wave will not deflect;

2) when each metamaterial segment is anisotropic to electromagnetic wave and the optical axis is perpendicular to the incident electromagnetic wave, the electromagnetic wave will not deflect either when exiting;

3) when each metamaterial segment is anisotropic to electromagnetic wave and the optical axis is not perpendicular to the incident electromagnetic wave, the electromagnetic wave will deflect when exiting.

If each metamaterial segment is material with uniform refractive indices but the incident direction of the electromagnetic wave is not perpendicular to the surface of the metamaterial sheet layer 3, the electromagnetic wave will deflect.

In order to make each metamaterial segment isotropic, each metamaterial unit cell 5 within the metamaterial segment should be isotropic. Furthermore, each artificial microstructure 2 in the segment should be isotropic. When the artificial microstructure 2 is 90-degree rotational symmetric structure, the metamaterial unit cell 5 will be isotropic to electromagnetic wave.

90-degree rotational symmetry is defined as follows: as to two dimensional planar structure, the structure will be coincident with the original structure on the plane when rotates arbitrarily 90-degree about a rotation axis perpendicular to the plane; as to three dimensional structure, if there are three rotation axes perpendicular to each other, if the structure can be coincident with the original structure or symmetric with the original structure about a interface when rotating 90-degree about any rotation axis, such structure can be a 90-degree rotational symmetric structure. Therefore, in order to achieve anisotropic, the artificial microstructure 2 of the present invention cannot be 90-degree rotational symmetric structure, i.e. it can only be non 90-degree rotational symmetric structure.

For example, the artificial microstructure 2 of the embodiment shown in FIG. 8 is a non 90-degree rotational symmetric structure and its respective metamaterial unit cell 5 is anisotropic. As to the artificial microstructure 2 of the embodiment shown in FIG. 9, if two first wires are completely equal and bisects each other perpendicularly and each of the second wires is equal and is bisected by the connected first wire perpendicularly, the two dimensional snow flake shaped artificial microstructure 2 is isotropic. Similarly, in FIG. 10, if the three first wires are completely equal and bisect each other perpendicularly, and each of the second wires is equal and is bisected by the connected first wire perpendicularly, such three dimensional snow flake shaped structure is also isotropic. All of the artificial microstructures are structures with anisotropic shape.

Anisotropic material can deflect electromagnetic wave under the condition that the incident electromagnetic wave is not perpendicular to its optical axis. Index ellipsoid 7 is used to represent refractive indices property. The size of the index ellipsoid 7 is used to represent the magnitude of the refractive indices.

As to any given metamaterial unit cell 5, the index ellipsoid 7 can be calculated by analog simulation software and calculation method in prior art, for example, referring to Electromagnetic parameter retrieval from inhomogeneous metamaterials, D. R. Smith. D. C. Vier, T. Koschny, C. M. Soukoulis, Physical Review E 71, 036617 (2005).

Figure 12:
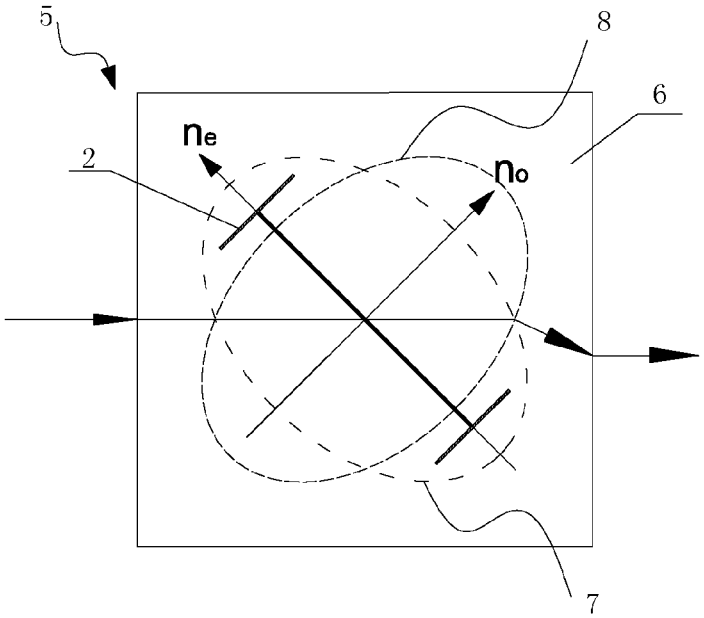
FIG. 12 is a schematic view showing the propagation direction of electromagnetic wave in the artificial microstructure.

As to the metamaterial unit cell 5 shown in FIG. 8, the extraordinary light optical axis $n_e$ (hereinafter called $n_e$ axis for short) and ordinary light optical axis $n_o$ (hereinafter called $n_o$ axis for short) are as shown in FIG. 12. Assuming that origin of coordinates is at the center of the index ellipsoid 7, the $n_o$ axis is x axis and $n_e$ axis is y axis, any point on the index ellipsoid 7 is represented by $n_x$ and $n_y$. When the electromagnetic wave is passing through the metamaterial unit cell 5 as shown in FIG. 12, the wave propagation ellipsoid 8 corresponding to this index ellipsoid 7 represented by $k_x$ and $k_y$ satisfy the following relationship:

$$k_y=n_x*\omega/c,\ k_x=n_y*\omega/c \tag{6}$$

wherein, ω is angular frequency of electromagnetic wave, c is speed of light, the wave propagation ellipsoid 8 and the index ellipsoid 7 share a common center. From the formula, the wave propagation ellipsoid 8 and the index ellipsoid 7 are similar geometric structure. The major axis direction of the wave propagation ellipsoid 8 is the minor axis direction of the index ellipsoid 7 and the minor axis direction of the wave propagation ellipsoid 8 is the major axis direction of the index ellipsoid 7.

The deflection direction of the electromagnetic wave after passing through the metamaterial unit cell 5 can be indicated through the wave propagation ellipsoid 8. As shown in FIG. 12, the electromagnetic wave incident in the direction shown in the figure will be intersected at a point on the surface with the wave propagation ellipsoid 8 it will exit. A tangent line of this intersection point with respect to the wave propagation ellipsoid 8 is drawed. The normal direction of the tangent line made from the intersection point is the energy propagation direction of electromagnetic wave. Therefore, electromagnetic wave propagates along this direction inside the element. When electromagnetic wave travel along this direction until exiting the metamaterial, after the normal extends until it intersects with the exiting surface, from the intersection point at the exiting surface, it will continue to exit along a direction parallel to the incident direction. This exit direction is the phase propagation direction of electromagnetic wave. That is to say, uniform and anisotropic material can change the energy propagation direction of the electromagnetic wave but cannot change its phase propagation direction. Translation will occur when the electromagnetic wave is exiting.

The premise of changing the energy propagation direction but not changing the phase propagation direction by the anisotropic material is that the material is a material with uniform refractive indices distribution. As to those metamaterials with non-uniform refractive indices distribution and anisotropic to electromagnetic wave, both of energy propagation direction and phase propagation direction of the electromagnetic wave will change after passing through such metamaterials. The following shows the influence to the propagation of electromagnetic wave by non-uniform refractive indices distribution and anisotropy by three embodiments.

Figure 13:
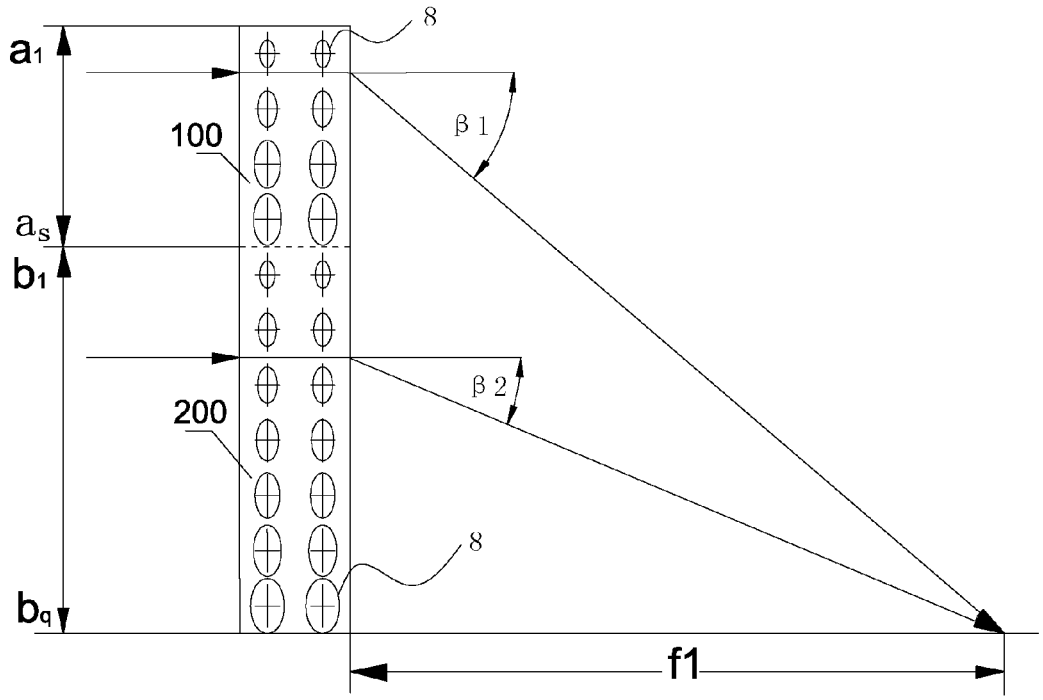
FIG. 13 is a schematic view showing propagation of the electromagnetic waves when major axis directions of the propagation ellipsoids of electromagnetic waves are parallel to y direction.
Figure 14:
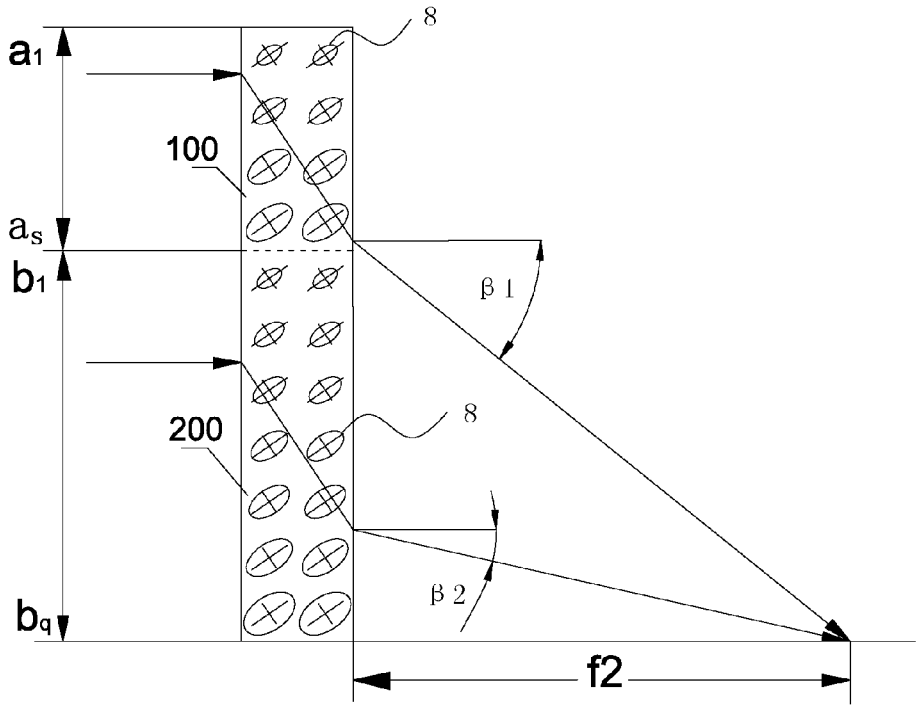
FIG. 14 is a schematic view showing the propagation of the electromagnetic waves when the major axis directions of the propagation ellipsoids of electromagnetic waves are oblique to y direction by an angle.
Figure 15:
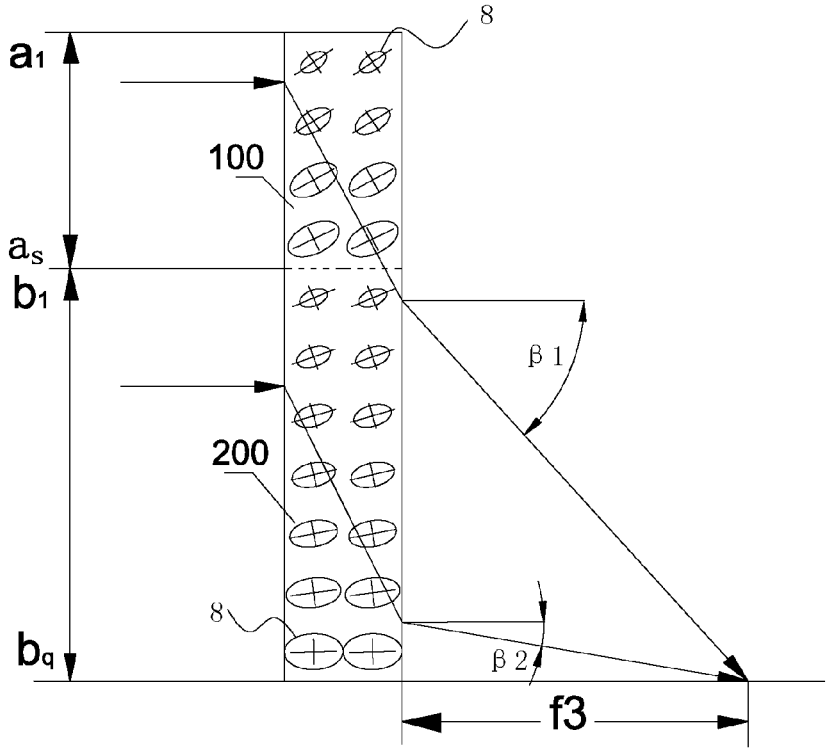
FIG. 15 is a schematic view showing the propagation of the electromagnetic waves when the propagation ellipsoids of electromagnetic waves in each artificial microstructure in y direction are sequentially gradually rotated.

The refractive indices distributions of the metamaterial sheet layers 3 according to three embodiments shown in FIG. 13, FIG. 14 and FIG. 15 all satisfy the above described characteristics. That is to say, the refractive indices of each column of the metamaterial unit cells along y direction sequentially are $a_1, a_2, a_3, \ldots, a_s, b_1, b_2, b_3, \ldots, b_q$, and satisfy the relationship formulas (1) to (6) and the formulas (1) to (6) do not adopt equal sign at the same time. Therefore, because the refractive indices magnitude distributions according to the three embodiments are the same, the non-uniform refractive indices distribution has the same influences to the three embodiments. That is to say, as to the same electromagnetic waves incident from the same position in the same direction, the deflection angles of their phase propagation directions are the same, as shown in FIG. 13 to FIG. 15. As to the electromagnetic waves from the same incident position in the same direction passing through the first metamaterial segment, the exiting deflection angles are all β5; as to another electromagnetic wave passing through the second metamaterial segment 200, the deflection angles through the three embodiments are all β6.

Each metamaterial unit cell shown in FIG. 13 is anisotropic and its respective wave propagation ellipsoid 8 is as shown in the figure. In this embodiment, the minor axes of the wave propagation ellipsoids 8, i.e., the direction of the extraordinary light optical axis of each metamaterial unit cell 5, are parallel to z direction, i.e., the incident direction of the electromagnetic wave. Therefore, without changing the energy propagation direction of the incident electromagnetic wave, the electromagnetic wave will deflect to a point away from the metamaterial by a distance f1 after exiting the metamaterial.

In the metamaterial sheet layer 3 shown in FIG. 14, the artificial microstructure 2 of each metamaterial unit cell 5 is the same as the artificial microstructure 2 of each each metamaterial unit cell 5 shown in FIG. 13. Therefore, the size and shape of each index ellipsoid 7 and each wave propagation ellipsoid 8 is the same as that in FIG. 13 respectively. However, each artificial microstructure 2 in FIG. 14 is the same as the respective artificial microstructure 2 in FIG. 13 rotated clockwise an angle θ less than 90-degree, so that the minor axis of respective each wave propagation ellipsoid 8 is parallel to each other. But the minor axis is not parallel to z direction, instead, it can extends to intersect with symmetric plane and includes an angle more than 0 but less than 90 with the symmetric plane.

As known from the propagation directions of electromagnetic wave shown in FIG. 12, the energy propagation direction of the electromagnetic wave inside this metamaterial sheet layer 3 will deflect towards the symmetry plane, equivalent to translate the electromagnetic wave towards the symmetry plane. The electromagnetic wave after translation will deflect when exiting from the metamaterial sheet layer 3 because of refractive indices change. That is to say, as to two electromagnetic wave beams which are the same as these in FIG. 13, after passing through the first metamaterial segment, the deflection angle of the electromagnetic wave will be β5; after passing through the second metamaterial segment, the deflection angle of the electromagnetic wave will be β6. Under the condition that exiting deflection angles are equal, the electromagnetic waves of the present embodiment will translate towards the symmetry plane because of anisotropy so that the distance f2 of deflection point of the two electromagnetic wave beams which are the same as FIG. 13 from the metamaterial is smaller than the deflection distance f1 shown in FIG. 13.

As to the metamaterial sheet layer 3 shown in FIG. 15, the artificial microstructures 2 of each metamaterial unit cell 5 is identical to that shown in FIG. 14, except that the artificial microstructures 2 of each column of the metamaterial unit cells along y direction respectively correspond to the respective artificial microstructures 2 in the embodiment shown in FIG. 14 rotated by an angle. Compared to the s+q artificial microstructures shown in FIG. 14, wherein the refractive indices are $a_1, a_2, a_3, \ldots, a_s, b_1, b_2, b_3, \ldots, b_q$, and the minor axes of the wave propagation ellipsoids 8 are all rotated by an angle θ about the symmetry plane, the s+q artificial microstructures shown in the embodiment of FIG. 15 are rotated by the following angles sequentially on the basis of FIG. 14: $\theta_1, \theta_2, \theta_3, \ldots, \theta_s, \theta_{s+1}, \ldots, \theta_{s+q-1}, \theta_{s+q}$. These rotation angles have the following relationship:

$$\theta_1 \le \theta_2 \le \theta_3 \le \ldots \le \theta_s \le \theta_{s+1} \le \ldots \le \theta_{s+q-1} \le \theta_{s+q} \tag{7}$$

The above relationship formula (7) does not adopt equal sign at the same time. $\theta_{s+q}$ is such that the minor axis of the wave propagation ellipsoid 8 corresponding to refractive indices bq is perpendicular or substantially perpendicular to z direction. That is to say, the extraordinary light optical axis of its index ellipsoid 7 is perpendicular to z direction or substantially perpendicular to z direction.

The wave propagation ellipsoid 8 of the anisotropic metamaterial unit cell known from FIG. 14 can rotate by an angle θ clockwise to decrease the deflection distance of the electromagnetic wave from the metamaterial. In present embodiment, further sequential rotation of the artificial microstructures 2 can cause the wave propagation ellipsoid 8 to rotate clockwise sequentially along z direction. Therefore, inside the metamaterial, the electromagnetic wave can be further deflected towards the symmetry plane whenever passing a metamaterial unit. The superposition of these deflections can cause the equivalent translation amount of the electromagnetic wave to increase when exiting. As a result, on the premise that the phase propagation deflection angles β5, β6 caused by non-uniform refractive indices remain constant, the distance to the defection point of the electromagnetic wave can be further decreased to f3. The f1, f2, f3 can have the following relationship between them:

$$f1<f2<f3 \tag{8}$$

from this, under the condition that the refractive indices distribution are the same, the distance from the deflection point of the electromagnetic wave to the metamaterial can be decreased, that is to say, the focal length can be reduced.

In other words, under the condition that both the refractive indices distributions and the focal lengths are the same, using anisotropic metamaterial sheet layer 3 whose extraordinary light optical axis s of index ellipsoid 7 is not perpendicular to and parallel to the symmetry plane (e.g., the embodiments shown in FIG. 14 and FIG. 15), the deflection angle of the electromagnetic wave is smaller than the deflection angle β5, β6 in the embodiment shown in FIG. 12. According to relationship formula (7), it can be inferred that at this time, by using the metamaterial sheet layer 3 made by the former, the length d in z direction can also be decreased. In short, in order to achieve similar deflection effects, the metamaterial sheet layers 3 shown in FIG. 14 and FIG. 15 have smaller length d in z direction than the metamaterial sheet layer 3 shown in FIG. 13 or isotropic metamaterial sheet layer 3. The benefits of such property is that it can reduce the use of material and the metamaterial can be made smaller and thus be beneficial to light weighting and miniaturization.

Figure 16:
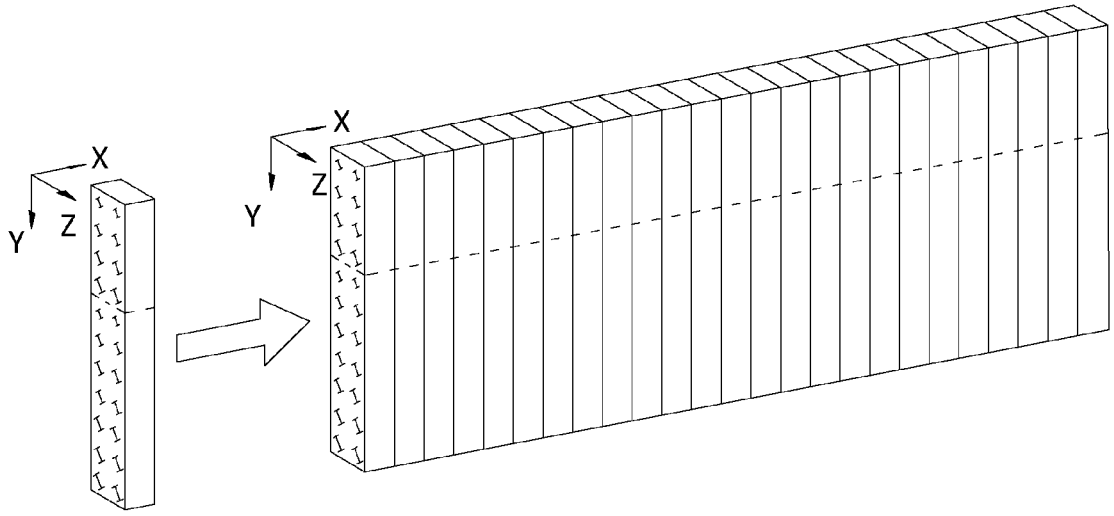
FIG. 16 is a schematic view showing metamaterial that deflects electromagnetic wave formed by a number of metamaterial sheet layers stacked together.

As shown in FIG. 16, the metamaterial of the present invention that deflects electromagnetic wave is made up by a number of metamaterial sheet layers 3 stacked along x direction and assembled together. Each metamaterial sheet layer 3 is spaced apart by air or the space between each of the metamaterial sheet layers 3 is tilled with material with a dielectric constant close to 1 and having no response to electromagnetic wave. When the metamaterial sheet layers 3 are in such a large amount that the length in x direction is much longer than the length in z direction, the whole metamaterial can be regarded as a sheet and the length in z direction is the thickness of the sheet. Therefore, as known from the above conclusion, by using anisotropic artificial microstructure 2 that can change the energy propagation direction of the electromagnetic wave, the thickness of the entire metamaterial that deflects electromagnetic wave can be decreased, thereby reducing materials consumption and realizing lightening, thinning and miniaturizing.

When the metamaterial sheet layers 3 making up the metamaterial are completely identical, the refractive indices of the metamaterial unit cells in each stacked row in x direction are the same. Then as to planar electromagnetic wave, when each metamaterial sheet layer 3 can deflect a column of electromagnetic waves passing it to a point, a number of metamaterial sheet layers 3 super positioned along x direction can deflect the electromagnetic waves into a line parallel to x direction.

In conclusion, the metamaterial of the present invention has the following characteristics:

1) The refractive indices distribution in xy plane is as shown in FIG. 12 and FIG. 13, the refractive indices along z direction remain constant, therefore, deflection can be achieved. The thickness in z direction can be made very small, now about 2-3 mm has been realized.

2) The artificial microstructure 2 on each metamaterial sheet layer 3 is designed to be anisotropic, and its index ellipsoid 7 is not perpendicular to or parallel to z direction. Therefore, the deflection of the energy propagation direction to the middle inside the metamaterial can be realized and thus the focal length of the deflected electromagnetic wave when exiting is decreased. The propagation range is narrowed. In other words, by realizing the same deflection effects, using anisotropic artificial microstructures 2 can make the metamaterial thinner.

3) the artificial microstructures 2 in y direction are sequentially rotated, which can further increase the translation amount of the electromagnetic wave in the metamaterial and thus decrease the focal length or similarly reduce the thickness of the metamaterial.

In practical applications, under given application environment, under the condition that the metamaterial has given size, location and focal length and the incident electromagnetic wave has given propagation characteristics, the deflection angle of the electromagnetic wave passing through each metamaterial unit cell 5 on the metamaterial can be first calculated; then the difference in refractive indices between adjacent two metamaterial unit cells 5 can be calculated by using formula (4); and, the distribution of refractive indices n on each metamaterial unit cell in x and y direction can be deduced by differentiation and integration. When considering the influences to energy propagation of the electromagnetic wave by anisotropy, it can be equivalent to that first considering the anisotropic structure cause the electromagnetic wave to translate towards the middle by a distance h when exiting and then at the translated exiting position, deflect relative to the original direction by an angle because of non-uniform refractive indices.

Because refractive indices are determined by the dielectric constant and permeability collectively, the refractive indices can be changed by changing the dielectric constant of the metamaterial unit cell 5 which is realized by changing shapes and dimensions of artificial microstructures 2. For example, the dielectric constant of the metamaterial unit cells 5 can be changed by changing the lengths of the artificial microstructures 2 shown in FIG. 8, FIG. 9 and FIG. 10.

As to artificial microstructures 2 with similar geometric shapes, the refractive indices of respective metamaterial unit cells 5 can increase with the increase of the dimensions of their artificial microstructures 2. Since the refractive indices in z direction remains constant, the artificial microstructures 2 of each row of metamaterial unit cells along z direction can be designed completely identical.

Traditional metamaterial can deflect electromagnetic wave by gradually increasing the refractive indices along y direction and/or x direction until a maximum value then gradually decreasing refractive indices. However, the dimensions of the artificial microstructures 2 are restricted by the based material unit cell which in turn should be within ⅕ of the wavelength of the incident electromagnetic wave in order to let the responses of the metamaterial to electromagnetic waves continuous. Therefore, the maximum dimension limit of the artificial microstructures should be ⅕ of the wavelength of the incident electromagnetic wave. At mean time, their refractive indices limit value is also restricted. When the refractive indices should increase to a maximum larger than the refractive indices limit value at this time, the deflection purpose is unable to be realized.

Since the deflection angle of the electromagnetic wave is related to the refractive change amount of the metamaterial along y direction rather than related to refractive indices value itself Therefore, the innovation points of the present invention lies in that: the deflection is realized by the first to second metamaterial segments with segmented refractive indices; the refractive indices change amount of each metamaterial segment along y direction can cause the deflection angle of the electromagnetic wave to realize the deflection function. The values of the refractive indices themselves always remain within a range. For example, the refractive indices of the second metamaterial segment along y direction are $a_1$, $a_2$, $a_3$, . . . , $a_s$ and the refractive indices of the second metamaterial segment along y direction are $b_1$, $b_2$, $b_3$, . . . , $b_q$, and the maximum values $a_s$, $b_q$ and minimum values $a_1$, $b_1$ of the two segments are equal respectively. This can solve the problem that the refractive indices values are too large to manufacture.

Meantime, under the condition that the dimension of the metamaterial is given and the maximum values and the minimum values of the refractive indices are the same, the metamaterial of the present invention is two metamaterial segments and each of the metamaterial segments can achieve its maximum value and minimum value. Comparing to traditional metamaterial whose refractive indices are not segmented but increase gradually, the average change rate of refractive indices of the present invention is twice of the average change rate of refractive indices of traditional material. Therefore, in present invention, the deflection angle of electromagnetic wave is much larger than that of the traditional metamaterial, and thus the focal length is reduced. In other words, in order to realize the same focal length, the thickness of the metamaterial can be reduced which is beneficial to minimization and lightening.

The embodiments of the present disclosure have been described above with reference to the attached drawings; however, the present disclosure is not limited to the aforesaid embodiments, and these embodiments are only illustrative but are not intended to limit the present disclosure. Those of ordinary skill in the art may further devise many other implementations according to the teachings of the present disclosure without departing from the spirits and the scope claimed in the claims of the present disclosure, and all of the implementations shall fall within the scope of the present disclosure.

What is claimed is:

1. A metamaterial for deflecting electromagnetic wave, including a functional layer made up by at least one metamaterial sheet layer, each of the metamaterial sheet layers including a substrate and a number of artificial microstructures attached onto the substrate, wherein:

the functional layer is divided into a plurality of strip-like regions, the refractive indices in all the strip-like regions continuously increase along the same direction and there are at least two adjacent first and second regions, wherein the refractive indices in the first region continuously increase from $n_1$ to $n_2$, the refractive indices in the second region continuously increase from $n_3$ to $n_4$, and $n_2>n_3$.

2. The metamaterial for deflecting electromagnetic wave according to claim 1, wherein: the functional layer of the metamaterial is formed by a number of metamaterial sheet layers with non-uniform refractive indices distribution stacked in a direction perpendicular to the surface of the sheet layers.

3. The metamaterial for deflecting electromagnetic wave according to claim 1, wherein: each of the artificial microstructures is a planar structure or spatial structure made up by at least one wire.

4. The metamaterial for deflecting electromagnetic wave according to claim 3, wherein: the wire is copper wire or silver wire.

5. The metamaterial for deflecting electromagnetic wave according to claim 4, wherein: the wires can attach to the substrate by means of etching, electroplating, drilling, photolithography, electron etching, or ion etching.

6. The metamaterial for deflecting electromagnetic wave according to claim 1, wherein: the substrate can be made of ceramic, polymer materials, ferroelectric materials, ferrite materials or ferromagnetic materials.

7. The metamaterial for deflecting electromagnetic wave according to claim 1, wherein: the artificial microstructure is axially symmetric structure.

8. The metamaterial for deflecting electromagnetic wave according to claim 7, wherein: the artificial microstructure is in the form of "I" shape, cross shape or back-to-back double E-shape.

9. The metamaterial for deflecting electromagnetic wave according to claim 1, wherein: the artificial microstructures are non-axially symmetric structure including scalene triangle, parallelogram or irregular closed curve.

10. The metamaterial for deflecting electromagnetic wave according to claim 1, wherein: the metamaterial also includes impedance matching layers disposed on two sides of the functional layer.

11. A metamaterial for deflecting electromagnetic wave, including a number of metamaterial sheet layers stacked integrally in x direction, and each of the metamaterial sheet layers including a number of metamaterial unit cells arranged in array, wherein, the y direction perpendicular to x direction is column of the array and the z direction perpendicular to x and y directions is rows of the array, each metamaterial unit cell having completely identical based material unit cells and artificial microstructures attached to the based material unit, wherein:

the refractive indices in each row of the metamaterial unit cells are the same, and the refractive indices of each column of the metamaterial unit cells sequentially are $a_1$, $a_2$, $a_3$, . . . , $a_s$, $b_1$, $b_2$, $b_3$, . . . , $b_q$, and each of the refractive indices satisfies $a_1 \le a_2 \le a_3 . . . \le a_s$, $b_1 \le b_2 \le b_3 . . . \le b_q$; wherein $b_1 < a_s$, and s and q are natural number no less than 2, the artificial microstructures are non 90-degree rotationally symmetric structures, and the extraordinary light optical axes of the index ellipsoids of at least part of the artificial microstructures are not perpendicular and not parallel to y direction.

12. The metamaterial for deflecting electromagnetic wave according to claim 11, wherein:

the refractive indices of each column of the metamaterial unit cells along y direction should satisfy the following relationship:

$$(a_2-a_1)\geq(a_3-a_2)\ldots\geq(a_s-a_{s-1})\geq(b_2-b_1)\geq(b_3-b_2)\ldots\geq(b_{q-1}-b_q).$$

13. The metamaterial for deflecting electromagnetic wave according to claim 12, wherein: the above refractive indices have the following relationship: $a_1=b_1$, $a_s=b_q$, q>s.

14. The metamaterial for deflecting electromagnetic wave according to claim 13, wherein: the size of each metamaterial unit cell is no more than 1/10 of the wavelength of the incident electromagnetic wave.

15. The metamaterial for deflecting electromagnetic wave according to claim 12, wherein: the extraordinary light optical axes of the respective index ellipsoids of the artificial microstructures in each row of the metamaterial unit cells in z direction are parallel to each other.

16. The metamaterial for deflecting electromagnetic wave according to claim 15, wherein: the extraordinary light optical axes of the respective index ellipsoids of the artificial microstructures in each column of the metamaterial unit cells in y direction are sequentially rotated clockwise, and the extraordinary light optical axes of the index ellipsoids of the row of artificial microstructures with refractive indices $b_q$ are parallel to y direction.

17. The metamaterial for deflecting electromagnetic wave according to claim 16, wherein: the refractive indices distribution of the number of the metamaterial sheet layers are completely identical so that the refractive indices of the metamaterial unit cells in each stacked row in x direction remain constant.

18. The metamaterial for deflecting electromagnetic wave according to claim 17, wherein: the geometric figures of the artificial microstructure is similar but the sizes increases with the increase of the refractive indices or decrease with the decrease of the refractive indices.

19. The metamaterial for deflecting electromagnetic wave according to claim 11, wherein: the artificial microstructure is in the form of "I" shape or Jerusalem cross shape.

20. The metamaterial for deflecting electromagnetic wave according to claim 11, wherein: the artificial microstructure is in the form of "snow flake" shape.

* * * * *